US008841893B2

(12) United States Patent
Bulzacchelli et al.

(10) Patent No.: US 8,841,893 B2
(45) Date of Patent: Sep. 23, 2014

(54) DUAL-LOOP VOLTAGE REGULATOR ARCHITECTURE WITH HIGH DC ACCURACY AND FAST RESPONSE TIME

(75) Inventors: John F. Bulzacchelli, Yonkers, NY (US); Carrie E. Cox, Apex, NC (US); Zeynep Toprak-Deniz, Norwalk, CT (US); Daniel J. Friedman, Sleepy Hollow, NY (US); Joseph A. Iadanza, Hinesburg, VT (US); Todd M. Rasmus, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 615 days.

(21) Appl. No.: 13/213,578

(22) Filed: Aug. 19, 2011

(65) Prior Publication Data

US 2012/0153910 A1 Jun. 21, 2012

Related U.S. Application Data

(60) Provisional application No. 61/423,824, filed on Dec. 16, 2010.

(51) Int. Cl.
*G05F 1/575* (2006.01)

(52) U.S. Cl.
CPC ..... *G05F 1/575* (2013.01)
USPC ..... 323/280

(58) Field of Classification Search
CPC ..... G05F 1/56; G05F 1/561; G05F 1/575
USPC ..... 323/265, 272–274, 280–282, 284, 288; 363/73, 74, 123
See application file for complete search history.

(56) References Cited

U.S. PATENT DOCUMENTS

| | | | | |
|---|---|---|---|---|
| 5,770,940 | A * | 6/1998 | Goder | 323/282 |
| 5,939,867 | A | 8/1999 | Capici et al. | |
| 6,147,478 | A * | 11/2000 | Skelton et al. | 323/284 |
| 6,856,124 | B2 | 2/2005 | Dearn et al. | |
| 6,914,476 | B2 | 7/2005 | Ingino, Jr. | |
| 7,132,820 | B2 * | 11/2006 | Walters et al. | 323/282 |
| 7,368,896 | B2 | 5/2008 | Nagata et al. | |
| 7,508,181 | B2 * | 3/2009 | Chen et al. | 323/282 |
| 7,589,584 | B1 | 9/2009 | Bui | |
| 7,652,455 | B2 | 1/2010 | Demolli | |
| 7,719,343 | B2 | 5/2010 | Burgener et al. | |
| 7,990,126 | B1 * | 8/2011 | Zhang et al. | 323/284 |
| 2009/0059627 | A1 | 3/2009 | Kim | |
| 2009/0206952 | A1 | 8/2009 | Dreps et al. | |

OTHER PUBLICATIONS

C.-E. Liu et al., "RFID Regulator Design Insensitive to Supply Voltage Ripple and Temperature Variation," IEEE Transactions on Circuits and Systems—II: Express Briefs, Apr. 2010, pp. 255-259, vol. 57, No. 4.

* cited by examiner

*Primary Examiner* — Adolf Berhane
*Assistant Examiner* — Jye-June Lee
(74) *Attorney, Agent, or Firm* — Anne V. Dougherty; Ryan, Mason & Lewis, LLP

(57) ABSTRACT

Dual-loop voltage regulator circuits and methods in which a dual-loop voltage regulation framework is implemented with a first inner loop having a bang-bang voltage regulator to achieve nearly instantaneous response time, and a second outer loop, which is slower in operating speed than the first inner loop, to controllably adjust a trip point of the bang-bang voltage regulator to achieve high DC accuracy.

25 Claims, 12 Drawing Sheets

900

DUAL-LOOP VOLTAGE REGULATOR ARCHITECTURE WITH HIGH DC ACCURACY AND FAST RESPONSE TIME

CROSS-REFERENCE TO RELATED APPLICATION

This application claims priority to U.S. Provisional Application Ser. No. 61/423,824, filed on Dec. 16, 2010, which is fully incorporated herein by reference.

TECHNICAL FIELD OF THE INVENTION

The present invention relates generally to voltage regulator circuits and methods and more specifically, dual-loop voltage regulator circuits and methods in which a dual-loop voltage regulation framework is implemented with a first inner loop having a bang-bang voltage regulator to achieve nearly instantaneous response time, and a second outer loop, which is slower in operating speed than the first inner loop, to controllably adjust a trip point of the bang-bang voltage regulator to achieve high DC accuracy.

BACKGROUND

In general, a voltage regulator is a circuit that is designed to maintain a constant output voltage level as operating conditions change over time. Electronic circuits are designed to operate with a constant DC supply voltage. A voltage regulator circuit provides a constant DC output voltage and contains circuitry that continuously holds the output voltage at the desired value regardless of changes in load current or input voltage (assuming that the load current and input voltage are within the specified operating range for the regulator). Maintaining accurate voltage regulation is particularly challenging when the load current variations are sudden and extreme, e.g., minimum load to maximum load demand in less than a couple hundred picoseconds. Such sudden and extreme variations in load current can occur in applications in which the circuitry being powered by the regulator is primarily CMOS logic. Since the majority of the current drawn by CMOS logic is dynamic (current that is used to charge and discharge parasitic capacitances) and not static (such as DC leakage currents), the load current presented to the regulator can change from a minimum to a maximum very quickly when the CMOS logic switches from an idle state to a state with high activity factor (maximum workload).

Linear voltage regulators are the most commonly used types of voltage regulators in integrated circuits (ICs) and have a number of advantages. Linear voltage regulators are fully integrable, requiring no off-chip components such as inductors. Unlike switching types, linear regulators generate no inherent ripple of their own, so they can produce a very "clean" DC output voltage, achieving low noise levels with minimal overhead (cost). Typically, a linear regulator operates by modulating the voltage drop across a series pass element, which can be modeled as a voltage-controlled resistance. The control circuitry monitors (senses) the output voltage. If the output voltage is lower than desired, a voltage is applied to the series pass element which decreases its resistance; since less voltage is dropped across the series pass element, the output voltage rises. Similarly, if the output voltage is higher than desired, the resistance of the series pass element is increased, so more voltage is dropped across the series pass element, and the output voltage falls. Since the output voltage correction is achieved with a feedback loop, some type of compensation is required to assure loop stability.

Most linear regulators have built-in compensation and are completely stable without external components. The need to maintain adequate loop stability (phase margin) limits the achievable bandwidth of linear regulators. Hence, any linear regulator requires a finite amount of time to correct the output voltage after a change in load current demand. This "time lag" defines the characteristic called transient response, which may not be fast enough for applications with sudden and extreme load current variations, such as with CMOS logic applications as noted above.

Another drawback of the limited loop bandwidth of linear regulators is that it is hard to achieve good power supply rejection ratios (PSRR) at high frequencies (e.g., 100 MHZ-1 GHz). Finally, the power efficiencies of linear regulators with even moderately fast transient responses tend to be low since significant static current is consumed in the wideband amplifier stages used to drive the series pass element.

A different approach to realizing a regulator capable of fast response to sudden changes in load current is to use a high-speed comparator as the primary error detector controlling the conduction of the series pass element. In particular, one type of voltage regulator which has very fast transient response characteristics is referred to as a "bang-bang" type voltage regulator, in which a high speed comparator is utilized to switch a series passgate element from fully on to fully off (and vice versa). The fast response time makes bang-bang type voltage regulators more suitable than their linear counterparts to handle highly varying load current demands with minimal effect on regulated voltage and with the capability of providing nearly instantaneous response to any variation in load current demand. The fast response time also improves the high-frequency power-supply rejection ratio (PSRR).

However, the use of bang-bang regulators poses design challenges with regard to the ability to achieve suitable DC accuracy on the regulated voltage (due to offsets of the high-speed comparator) and to limit the intrinsically generated ripple on the regulated output that results from the sudden switching of the passgate current (bang-bang operation). Another problem arises when a distributed regulator system is formed by connecting the outputs of multiple bang-bang regulators to a common supply grid, as even small mismatches in comparator offsets may result in highly unequal sharing of the load current.

SUMMARY

In general, exemplary embodiments of the invention include dual-loop voltage regulator circuits and methods in which a dual-loop voltage regulation framework is implemented with a first inner loop having a bang-bang voltage regulator to achieve nearly instantaneous response time, and a second outer loop, which is slower in operating speed than the first inner loop, to controllably adjust a trip point of the bang-bang voltage regulator to achieve high DC accuracy.

In one exemplary embodiment of the invention, a voltage regulator circuit includes an error amplifier, a charge pump circuit connected to an output of the error amplifier, a comparator, and a first passgate device. The error amplifier compares a first reference voltage and a regulated voltage at an output node of the voltage regulator circuit and generates a first control current and a second control current based on a result of comparing the first reference voltage and the regulated voltage. The charge pump circuit dynamically generates a second reference voltage in response to the first and second control currents output from the error amplifier. The comparator compares the second reference voltage and the regulated voltage and generates a gate control signal based on a result of comparing the second reference voltage and the regulated voltage. The first passgate, which is connected to the output node, is controlled in a bang-bang mode of operation by the gate control signal to supply current to the output node.

In another embodiment, the charge pump circuit dynamically generates the second reference voltage by switchably applying the first and second currents to a charge pump capacitor, connected at an output of the charge pump circuit, to charge and discharge the capacitor. The charge pump circuit may include a switching circuit that is controlled by an inverted version or a buffered version of the gate control signal to switchably apply the first and second control currents to the charge pump capacitor.

In another exemplary embodiment of the invention, an integrated circuit includes a power grid, a load circuit connected to the power grid, and a distributed voltage regulator system. The distributed voltage regulator system includes a voltage regulator control circuit and one or more micro-regulator control circuits. Each of the one or more micro-regulator control circuits are controlled by the voltage regulator control circuit to generate a regulated voltage at an output node of the voltage regulator circuit, where each output node is connected to a different point on the power grid to supply the regulated voltage to the load circuit. The voltage regulator control circuit includes an error amplifier to compare a first reference voltage to a regulated voltage at an output node of the voltage regulator circuit, and to generate a first control current and a second control current based on a result of comparing the first reference voltage and the regulated voltage.

Moreover, each of the one or more micro-regulator control circuits includes a charge pump circuit, connected to an output of the error amplifier, to dynamically generate a respective second reference voltage in response to the first and second control currents output from the error amplifier, a comparator to compare the respective second reference voltage and the regulated voltage and generate a gate control signal based on a result of comparing the second reference voltage and the regulated voltage, and a first passgate device connected to the output node, wherein the first passgate device is controlled in a bang-bang mode of operation by the gate control signal to supply current to the output node.

In yet another exemplary embodiment of the invention, a method for regulating voltage includes comparing a reference voltage with a regulated voltage, generating a first control current and a second control current based on a result of comparing the reference voltage with the regulated voltage, and dynamically generating a second reference voltage based on the first and second control currents. The second reference voltage is dynamically generated by outputting the first and second control currents to a charge pump circuit, and switchably applying the first and second control currents to a charge pump capacitor, connected at an output of the charge pump circuit, to charge and discharge the capacitor. The method further includes comparing the second reference voltage with the regulated voltage, generating a gate control signal based on a result of comparing the second reference voltage with the regulated voltage, and controlling a first passgate device in a bang-bang mode of operation using the gate control signal to supply current to a regulated voltage output node.

These and other exemplary embodiments, aspects and features of the present invention will become apparent from the following detailed description of exemplary embodiments thereof, which is to be read in connection with the accompanying drawings.

DETAILED DESCRIPTION OF EXEMPLARY EMBODIMENTS

Figure 1:
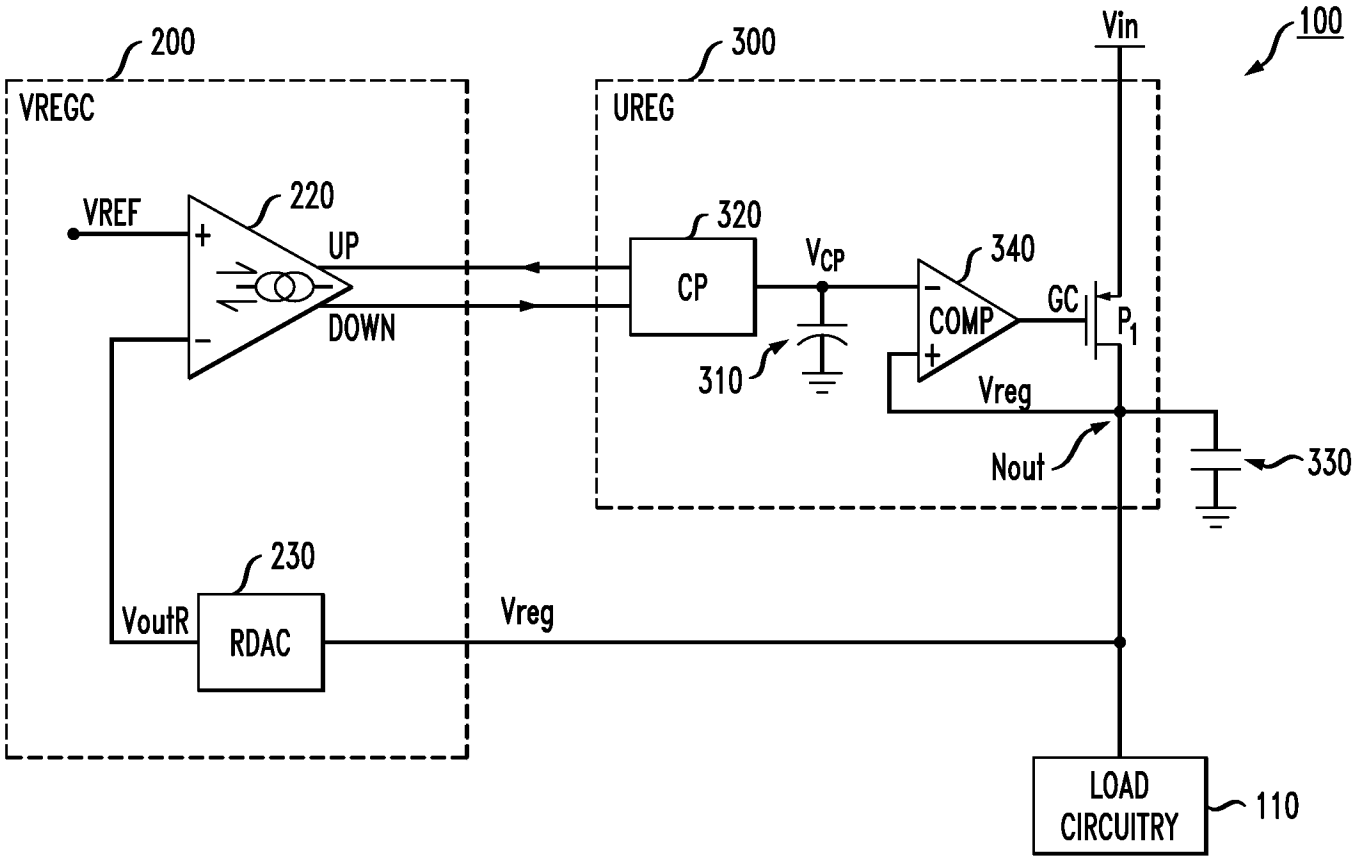
FIG. 1 schematically illustrates a dual-loop voltage regulator system according to an exemplary embodiment of the invention.

FIG. 1 schematically illustrates a dual-loop voltage regulator system according to an exemplary embodiment of the invention. In particular, FIG. 1 schematically illustrates a high-level block diagram of a dual-loop voltage regulator system 100 comprising a voltage regulator controller 200 (referred to herein as "VREGC") and at least one micro-regulator controller 300 (referred to herein as "UREG"), which operate to maintain a regulated voltage Vreg at an output node Nout connected to load circuitry 110. The VREGC 200 generally comprises an error amplifier 220 and an RDAC (resistive digital analog controller) circuit 230. The UREG 300 generally comprises a charge pump circuit 320 connected to an output of the error amplifier 220, a capacitor 310 connected to the output of the charge pump 320, a high-speed comparator 340, a passgate device P1 and a decoupling capacitor 330 connected between the regulated output node Nout and ground.

In general, the error amplifier 220 compares a first reference voltage VREF (or "set point") and the regulated voltage Vreg (or VoutR, which is a fraction of Vreg) at the output node Nout of the voltage regulator circuit 100, and generates a first control current (UP current) and a second control current (DOWN current) based on a result of comparing the first reference voltage VREF and the regulated voltage Vreg. The charge pump circuit 320, which is connected to an output of the error amplifier 220, dynamically generates a second reference voltage $V_{CP}$ (or "trip point') across the capacitor 310 in response to the first and second control currents (UP/DOWN) output from the error amplifier 220. The comparator 340 compares the second reference voltage $V_{CP}$ and the regulated voltage Vreg and generates a gate control signal GC based on a result of comparing the second reference voltage $V_{CP}$ and the regulated voltage Vreg. The passgate device P1 (connected to the output node Nout) is controlled by the gate control signal GC to be fully turned on/off in a bang-bang mode of operation to supply current to the output node Nout.

The voltage regulator of FIG. 1 provides a dual-loop voltage regulation framework that is implemented with a first inner loop having a bang-bang voltage regulator to achieve nearly instantaneous response time, and a second outer loop, which is slower in operating speed than the first inner loop, to controllably adjust a trip point of the bang-bang voltage regulator to achieve high DC accuracy. More specifically, the UREG 300 includes the high-speed comparator 340 to turn the passgate P1 fully on and fully off in a bang-bang fashion. The toggling (oscillation) frequency of the output of the high-speed comparator 340 is limited by the delay of the comparator 340. With deep sub-micron CMOS technology, 1-2 GHz oscillation of the comparator 340 output can be attained without excessive power penalty.

While the UREG 300 oscillates in a bang-bang fashion (inner high-speed loop), a stable closed loop (outer low-speed loop) system is provided by the VREGC 200 which compares the regulated output voltage Vreg to VREF and provides feedback signals (UP/DOWN currents) to the charge pump 320 to tune the trip point ($V_{CP}$) of the comparator 340 in the UREG 300. The adjustment of the trip point voltage ($V_{CP}$) by the slow outer loop compensates for any DC voltage offset of the high-speed comparator 340 in the UREG 300. The heart of VREGC 200 is the transconductance error amplifier 220 which is optimized for high gain and low offset. In this way, the voltage regulator system 100 maintains the DC accuracy of a linear regulator while providing nearly instantaneous response time (and better high-frequency supply noise rejection) of fully on/off (bang-bang) control. Since CMOS inverters can be used to drive the gate of the passgate P1 without static power dissipation, the power efficiency of the regulator can be reasonably high (given GHz-speed response times).

In the VREGC 200, the error amplifier 220 comprises a non-inverting input terminal "+" and an inverting input terminal "−". The reference voltage VREF is input to the non-inverting input terminal of the error amplifier 220. The reference voltage VREF may be a static voltage that is generated using a bandgap reference circuit or one of other various techniques known to those of ordinary skill in the art. The inverting input terminal "−" of the error amplifier 220 is connected to an output of the RDAC 230 to receive a regulated voltage VoutR which is some percentage (e.g., 75%) of the regulated voltage Vreg. The RDAC 230 may be implemented with a well-known conventional architecture having a resistor divider network where different resistive paths are activated or deactivated by digital bits to change a resistive ratio, the details of which are well known to those of ordinary skill in the art.

The error amplifier 220, which has low bandwidth requirements, is implemented with an architecture providing high DC accuracy, and thus providing high DC stability and accuracy in the overall voltage regulator system 100. An exemplary architecture for implementing the error amplifier 220 will be discussed in further detail below with reference to FIG. 6. The error amplifier 220 compares VREF to VoutR, which, as noted above, may be some percentage of Vreg. This may be implemented in instances where Vreg may be relatively high compared to a supply voltage Vin of the error amplifier 220, so by inputting VoutR as some lower (percentage) value of Vreg, we may eliminate possible DC error due to the high common mode of the error amplifier 220.

The error amplifier 220 compares VREF and VoutR and generates and outputs UP and DOWN currents as feedback to the charge pump 320 in the UREG 300. In response, the charge pump 320 charges or discharges the capacitor 310 to dynamically adjust a charge pump voltage $V_{CP}$ stored across the capacitor 310. An exemplary architecture for implementing the charge pump circuit 320 and UREG 300 will be discussed in further detail below with reference to FIG. 2. The charge pump voltage $V_{CP}$ serves as a local reference voltage that is input to an inverting input "−" terminal of the high-speed comparator 340. A non-inverting input terminal "+" of the high-speed comparator 340 is connected to the regulated voltage output node Nout and receives Vreg as negative feedback. The passgate device P1 may be a P-type FET (field effect transistor) having a gate terminal G, source terminal S and drain terminal D. The gate terminal G of the passgate P1 is coupled to the output of the comparator 340. The source terminal S of the passgate P1 is coupled to a supply voltage Vin and the drain terminal D of the passgate P1 is coupled to the output node Nout. The output decoupling capacitor 330 is coupled between the output node Nout and ground.

Figure 11A:
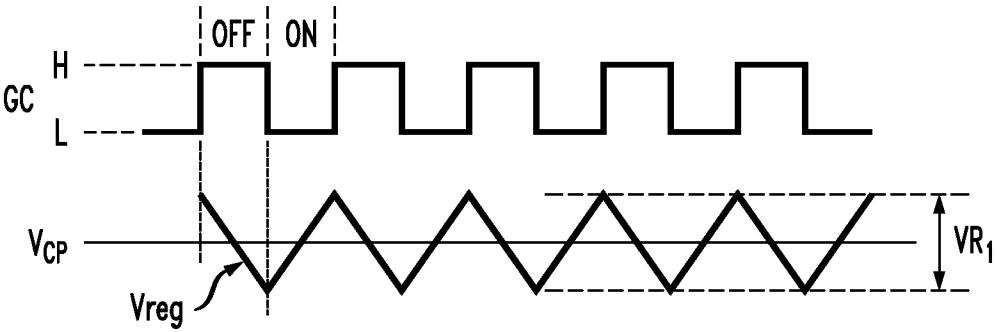
FIGS. 11A and 11B are waveform diagrams illustrating a relationship between voltage regulator oscillation frequency and ripple amplitude of the regulated voltage output.

The UREG 300 operates in a bang-bang manner by generating a limit-cycle oscillation as follows. The high-speed voltage comparator 340 compares the regulated voltage Vreg with the reference voltage $V_{CP}$ and generates gate control signal GC which fully turns the PFET passgate P1 On and Off in a bang-bang fashion. FIG. 11A depicts exemplary waveform diagrams of a gate control signal GC, reference voltage $V_{CP}$ and a regulated voltage Vreg that can be generated by operation of the UREG 300. With reference to FIG. 11A, when the regulated voltage Vreg falls below $V_{CP}$, the passgate control signal GC (output from high-speed comparator 340) will transition to a logic "zero" level after a propagation delay of the critical gate control path. The passgate P1 will turn on and start to charge the capacitor 330 connected to the regulated voltage output node Nout (working against the load current), and hence the regulated voltage Vreg will increase. When the regulated voltage Vreg rises above the reference threshold $V_{CP}$, the passgate control signal GC (output from high-speed comparator 340) will transition to a logic "high" level after a propagation delay of the critical gate control path, turning off the passgate P1. While the passgate P1 is turned off, the load current will discharge the regulated output voltage Vreg at some rate. When the regulated voltage Vreg falls below $V_{CP}$, the entire cycle repeats. In this way, regulation is achieved by continuous oscillation of the passgate control signal GC.

In the exemplary waveform diagram of FIG. 11A, the duty cycle of the gate control signal GC is depicted as 50%. However, a general operating principle of the bang-bang control is that the duty cycle (On/Off time of passgate P1) is adjusted so that on average the drain current of the passgate P1 is equal to the load current. As an example, if the load current is 30 mA, and the ON current of the passgate P1 is 50 mA, then the bang-bang voltage regulator duty cycle will be 60% after the regulator reaches equilibrium.

Figure 11B:
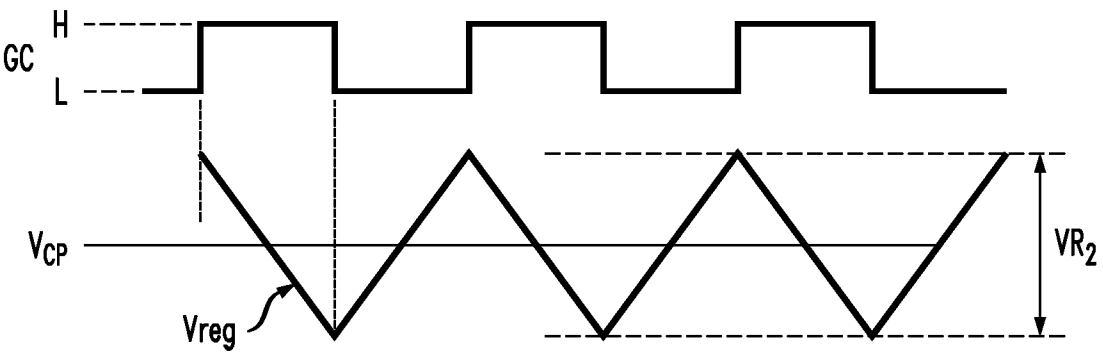

In order to minimize over/under shoot (ripple amplitude) of the regulated voltage Vreg, various design factors are considered. For example, to reduce the ripple of Vreg, the response time of the bang-bang regulator circuit should be minimized. In other words, the propagation delay of the critical path controlling the passgate P1 should be minimized. FIGS. 11A and 11B illustrate a relationship between the bang-bang regulator oscillation frequency of the gate control signal GC and ripple amplitude of Vreg. In the exemplary embodiments of FIGS. 11A and 11B, the oscillation frequency of the passgate control signal GC in FIG. 11B is smaller than the oscillation frequency of the passgate control signal GC in FIG. 11A (where it is assumed that the duty cycle of GC in FIGS. 11A and 11B is 50%). The lower oscillation frequency of GC directly translates to higher voltage ripple (VR) of Vreg, where VR2 in FIG. 11B is depicted as being greater than VR1 in FIG. 11A, which is not desirable. Assuming the duty cycle is close to 50%, and assuming an ideal capacitor without a series resistance, the theoretical period of the ripple of Vreg is approximately equal to four times the propagation delay Tprop of the bang-bang regulator. In practice, where a capacitor having an equivalent series resistance (ESR) is used, the delay may be closer to two times the propagation delay.

As explained in further detail below with reference to FIGS. 9 and 10, various control techniques and circuit architectures may be implemented in conjunction with a micro-regulator circuit to significantly reduce ripple amplitude by calibrating the strength (device width/current capability) of the passgate P1 depending on the anticipated load and/or VDS (drain-to-source voltage) headroom.

Figure 2:
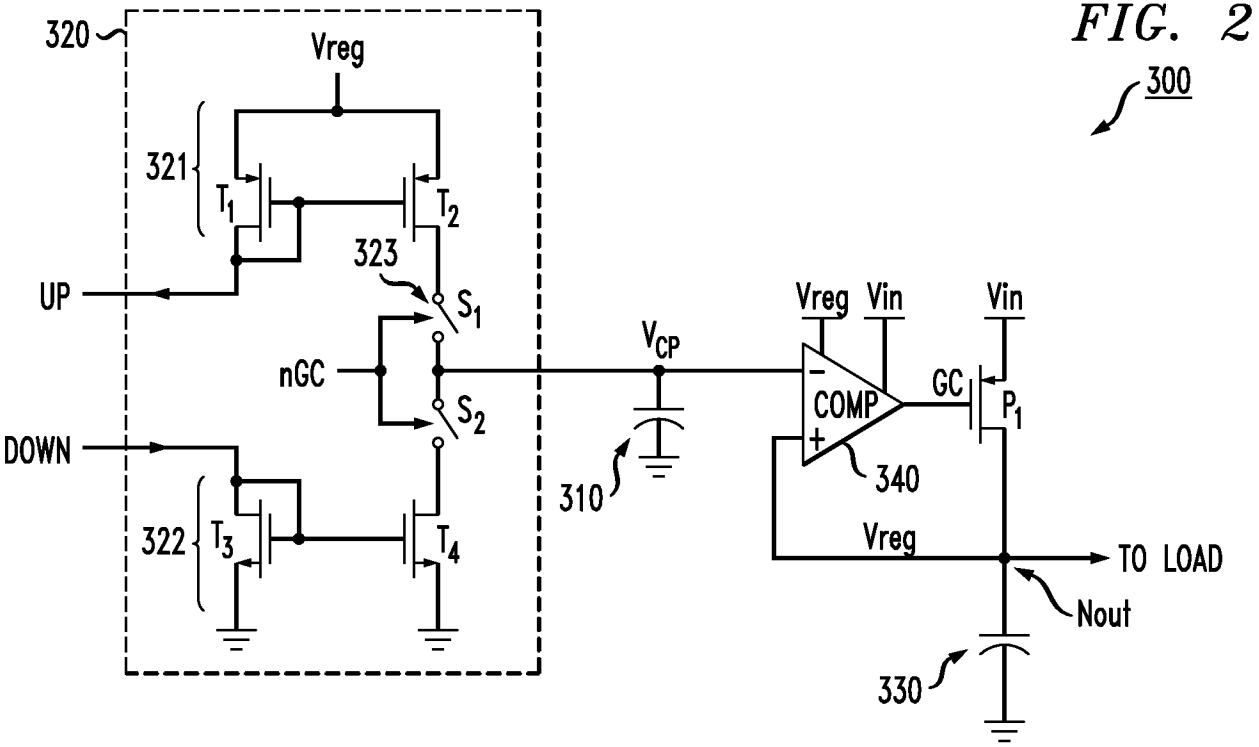
FIG. 2 schematically illustrates a micro-regulator circuit according to an exemplary embodiment of the invention.

FIG. 2 schematically illustrates a micro-regulator circuit according to an exemplary embodiment of the invention. More specifically, FIG. 2 schematically illustrates an exemplary embodiment of the UREG 300 of FIG. 1 and, in particular, an exemplary embodiment of the charge pump circuit 320. In FIG. 2, the charge pump circuit 320 comprises a first current mirror circuit 321 formed by transistors T1 and T2, a second current mirror circuit 322 formed by transistors T3 and T4, and a switching circuit 323 comprising switches S1 and S2. The current mirror 321 operates by mirroring UP current, which flows through T1, to transistor T2, to thereby charge the capacitor 310 with UP current when switch S1 is activated. The current mirror 322 operates by mirroring DOWN current, which flows through T3, to transistor T4, to thereby discharge the capacitor 310 with DOWN current when switch S2 is activated.

In the exemplary embodiment of FIG. 2, the switching circuit 323 of the charge pump 320 is shown to be driven by an inverted version nGC of the passgate control signal GC that drives the gate of the passgate P1 (although in other exemplary embodiments of the invention having a different charge pump framework, the charge pump can be driven by a buffered version of the passgate control signal GC). The switching circuit 323 can be implemented using a CMOS inverter topology, wherein switch S1 is a PFET and switch S2 is an NFET having commonly connected gate terminals that receive the switching signal nGC. In this embodiment, the voltage $V_{CP}$ across the capacitor 310 is charged UP when the passgate P1 is turned "off" (i.e., GC is logic "1" and nGC is logic "0" which activates switch S1) and the voltage $V_{CP}$ across the capacitor 310 is charged DOWN when the passgate P1 is turned "on" (i.e., GC is logic "0" and nGC is logic "1" which activates switch S2).

As noted above, the UP and DOWN currents are set by the error amplifier 220 of the VREGC 200 (as shown in FIG. 1) and the UP and DOWN currents are used to charge/discharge the voltage $V_{CP}$ across the capacitor 310. For a given UP and DOWN current set by the error amplifier 220, a steady state charge balance (i.e., voltage VCP) on the capacitor 310 is achieved when:

$$\frac{\text{UP}}{\text{DOWN}} = \frac{D}{1-D} \tag{1}$$

wherein D denotes a duty cycle of the passgate P1 conduction.

As noted above, the VREGC 200 forms part of the outer (slow) feedback loop, which operates as follows. When the error amplifier 220 detects that the DC voltage on the regulated supply Vreg (or some percentage thereof. VoutR) is lower than the reference voltage VREF, the error amplifier 220 increases the UP current and decreases the DOWN current output to the charge pump 320 of the UREG 300. In this circumstance, with reference to equation (1) above, the UP/DOWN ratio increases. This causes the charge pump 320 to charge $V_{CP}$ on the capacitor 310 upwards, which raises the trip point of the high-speed comparator 340 in the UREG 300, and which causes the local regulated output Vreg on the output capacitor 330 to be charged to a higher voltage. On the other hand, when the error amplifier 220 detects that the DC voltage on the regulated supply Vreg (or some percentage thereof. VoutR) is higher than the reference voltage VREF, the error amplifier 220 decreases the UP current and increases the DOWN current. In this circumstance, the UP/DOWN ratio decreases (in Eqn. (1)). This causes the charge pump 320 to discharge $V_{CP}$ on the capacitor 310, which lowers the trip point of the high-speed comparator 340 in the UREG 300, and which causes the local regulated output Vreg on the output capacitor 330 to be charged to a lower voltage.

Figure 12A:
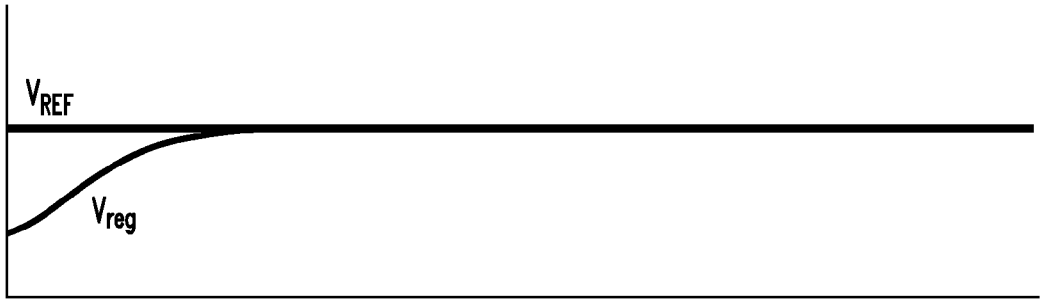
FIGS. 12A, 12B, and 12C are waveform diagrams illustrating a voltage regulation operation according to an exemplary embodiment of the invention in which a primary error amplifier generates UP/DOWN control currents to correct a negative DC error on a regulated voltage.
Figure 12B:
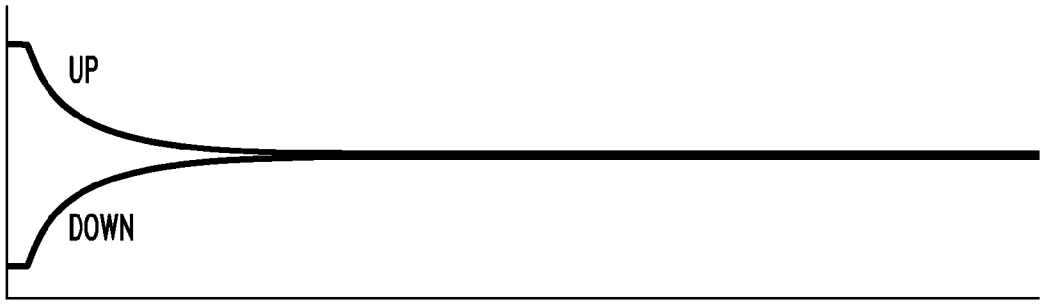
Figure 12C:
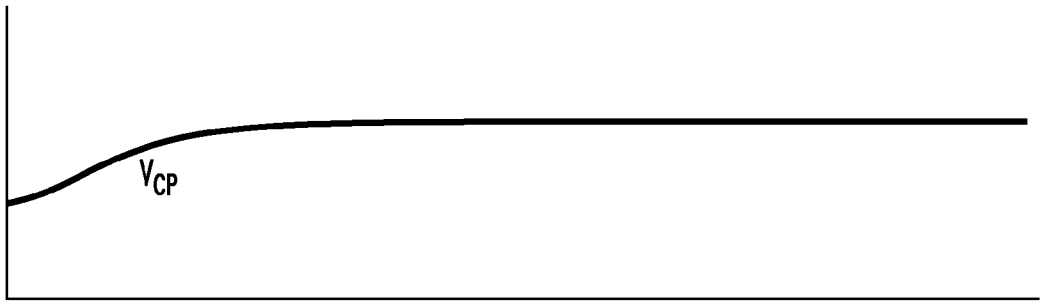

FIGS. 12A, 12B, and 12C are diagrams illustrating a voltage regulation operation according to an exemplary embodiment of the invention. In particular, FIGS. 12A, 12B, and 12C illustrate how the VREGC 200 controls the charge pump with UP/DOWN currents to correct a negative DC error on the regulated voltage. FIG. 12A illustrates an initial state at which Vreg is lower than VREF. FIG. 12B illustrates UP and DOWN current waveforms that are generated by the error amplifier 220 and output to the charge pump 320 to correct a negative DC error. FIG. 12C is a diagram illustrating the reference voltage $V_{CP}$. In FIG. 12A, when the error amplifier 220 senses that Vreg is lower than VREF, it increases the UP current and decreases the DOWN current. FIG. 12B illustrates an initial time where the UP current is at a maximum and the DOWN current is at a minimum to correct for the initial negative DC error. As the reference voltage $V_{CP}$ increases over time (FIG. 12C), Vreg also increases (FIG. 12A), and the UP current decreases and the DOWN current increases, and then stay constant when reaching an equilibrium as the system settles. FIG. 12B illustrates a 50% duty cycle condition whereby the UP/DOWN currents converge to equal values in steady state (i.e., UP/DOWN ratio=1 in Eqn. 1).

An advantage of this charge pump-based system is that the DC accuracy of the regulated voltage Vreg is determined by the VREGC error amplifier 220, which has modest bandwidth requirements and can be optimized for dc precision (e.g., low offset and high gain). After settling, the tuned charge pump voltage $V_{CP}$ in the UREG 300 automatically compensates any offset of the high-speed comparator 340, so such offset does not degrade the accuracy of the closed-loop regulator system.

Figure 3:
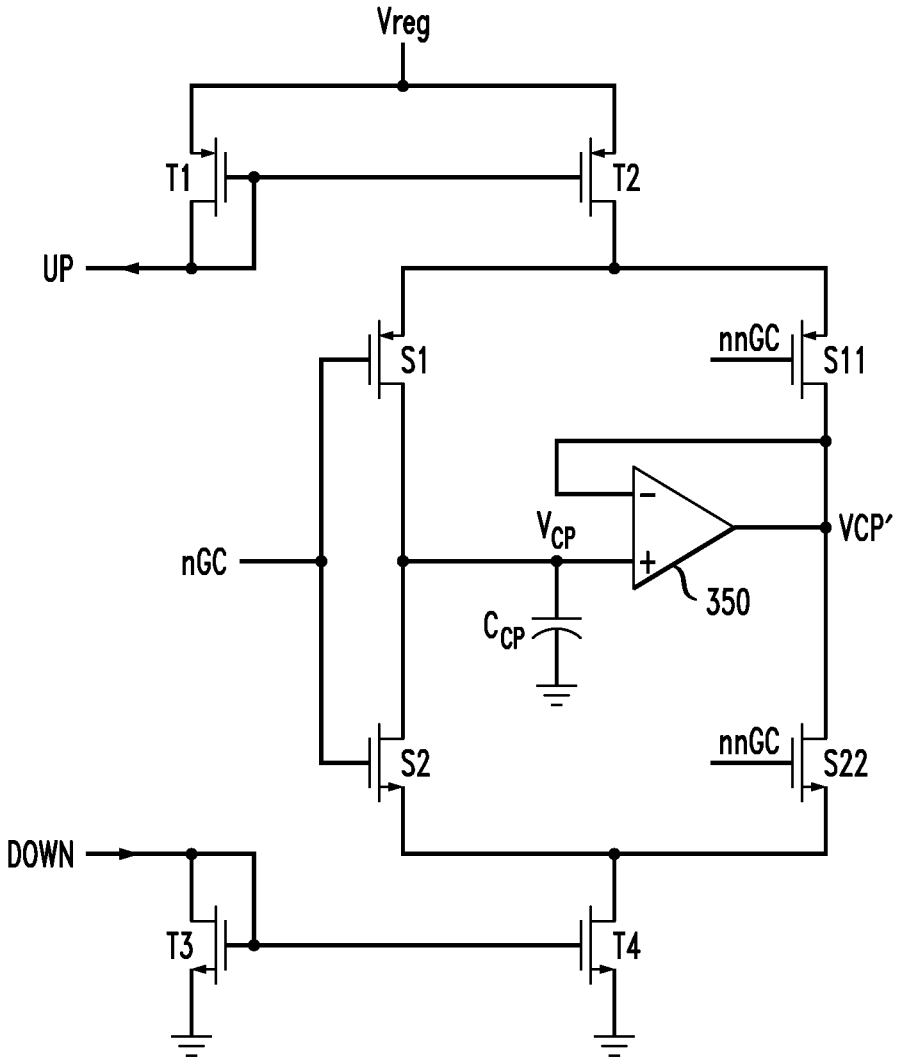
FIG. 3 schematically illustrates a charge pump circuit having a current steering circuit to eliminate charge redistribution errors, according to an exemplary embodiment of the invention.

To eliminate charge redistribution errors in the charge pump, the basic charge pump circuit 320 shown in FIG. 2 can be improved by applying a conventional current steering technique. In particular, FIG. 3 schematically illustrates a charge pump circuit having a current steering circuit to eliminate charge redistribution errors, according to an exemplary embodiment of the invention. FIG. 3 shows a charge pump framework 320', which is a modified version of the charge pump 320 of FIG. 2, in which the switches S1 and S2 are implemented by a PFET S1 and NFET S2 respectively, with a common gate input receiving control signal nGC. The charge pump circuit 320' further includes transistors S11 and S22 and an OpAmp 350, which are added to the basic charge pump circuit 320 of FIG. 2. The transistors S11 and S22 are controlled with the opposite polarity of the nGC signal (nnGC), which of course matches the polarity of the gate control signal GC. For example, when S1 is off and S2 is sinking DOWN current from the $V_{CP}$ node, the transistor S11 is turned On to steer the UP current to the output of the OpAmp 350, which is connected as a voltage follower to produce voltage VCP' (which closely matches $V_{CP}$). This minimizes the charging/discharging of the drain nodes of transistors T2 and T4, which improves the accuracy of the charge pump.

Figure 4:
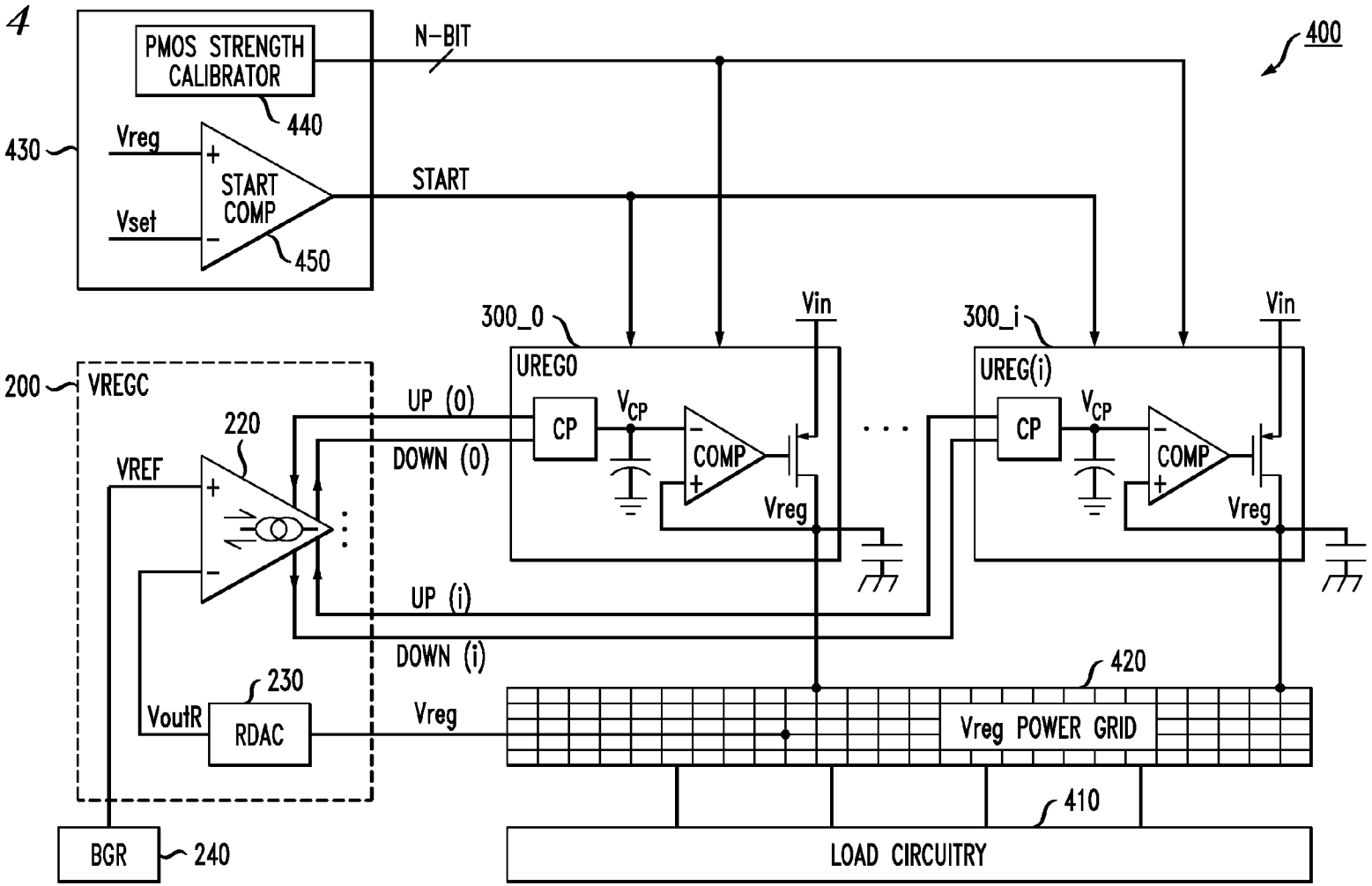
FIG. 4 is a schematic diagram of an integrated circuit having a distributed voltage regulator system according to an exemplary embodiment of the invention.

While the exemplary voltage regulator system 100 of FIG. 1 illustrates one UREG 300 controlled by the VREGC 200, the basic framework of FIG. 1 can be extended to implement a distributed voltage regulator system by using multiple UREGs that are controlled by one VREGC 200. For example, FIG. 4 is a schematic diagram of an integrated circuit 400 having a distributed voltage regulator system according to an exemplary embodiment of the invention. In particular, FIG. 4 depicts a distributed voltage regulator system comprising a VREGC 200 that drives a plurality of UREGs 300-0, . . . , **300-*i* (collectively denoted 300) having regulated voltage output nodes Nout connected to load circuitry 410 (e.g., CMOS logic circuitry) via a Vreg power grid 420. In the exemplary embodiment of FIG. 4, the VREGC 200 and each of the UREGs 300 may be implemented using frameworks as discussed herein. The UREGs 300 are disposed at various regions of the chip such that the regulated voltage outputs Vreg of the UREGs are connected at different points of the power grid 420 to collectively provide the desired Vreg to the load circuitry 410 connected to the Vreg power grid 420. The Vreg power grid 420 may comprise one or more metallization layers formed over an active surface of the chip 400 having the load circuitry 410**.

In this embodiment, the VREGC 200 monitors the DC accuracy of Vreg at a single sense point on the Vreg power grid 420, while each UREG 300 monitors Vreg at a different local sense point on the Vreg power grid 420 to which the given UREG 300 is connected. The VREGC 200 compares VREF (set point), which is generated by a bandgap reference circuit 240, with VoutR (which is Vreg or a percentage thereof), and adjusts the UP control current and the DOWN control current, which are output to each UREG 300. Each UREG 300 has its own dedicated charge pump circuit and the VREGC 200 outputs matched UP/DOWN control currents (UP0/DOWN0 UP(i)/DOWN(i)) to respective UREGs 300-0, . . . **300-*i* (as opposed to delivering the same CP voltage to distributed UREGs). Since each UREG 300 receives the same UP/DOWN control currents in its own dedicated charge pump circuit, it follows from Eqn. 1 that the steady state duty cycles among the multiple UREGs 300** will be equal, even in the face of mismatch, process variations, IR drops, etc.

More specifically, with this distributed framework, when a load current step occurs at a given area of the power grid 420, the UREGs 300 connected to that area of the power grid 420 will sense a drop in the Vreg voltage more than other UREGs 300 connected to the power grid 420 in other areas of the power grid 420. As such, the UREGs connected closest to that area of the grid where the current load step occurs will increase their duty cycles more than those UREGs connected further away from that area of the grid to compensate for the different drops in Vreg that are sensed at different regions of the power grid 420 due to the current load step occurring at a given point in the power grid 420. However, although the UREGs may initially supply different amounts of current to the power grid 420 in response to the load current step, eventually the charge pumps in the UREGs will be adjusted so that the duty cycles of all the UREGs will become equal in steady state (in accordance with Eqn. 1) so that the UREGs will supply virtually the same amount of current to the power grid 420 for the given current load draw.

Figure 5A:
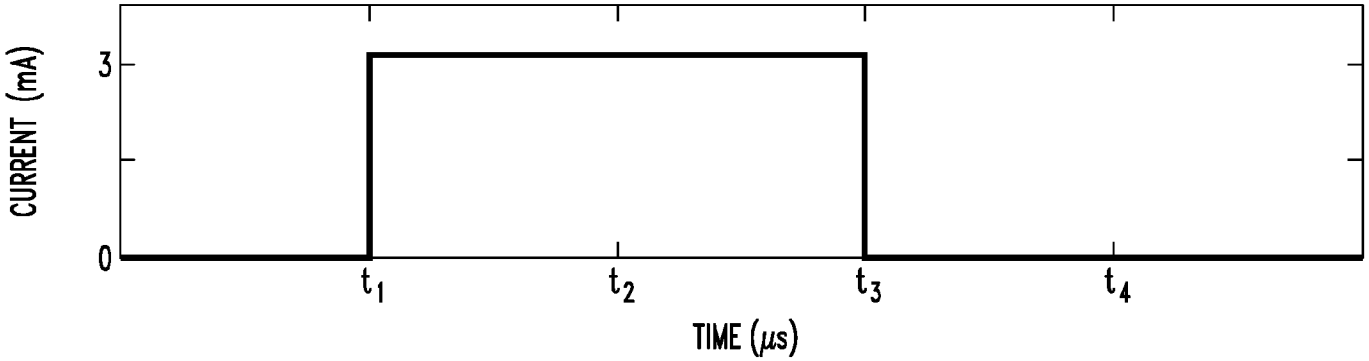
FIGS. 5A and 5B are diagrams that illustrate a simulated response of a distributed voltage regulator system to an unbalanced load demand across a voltage regulated power grid.
Figure 5B:
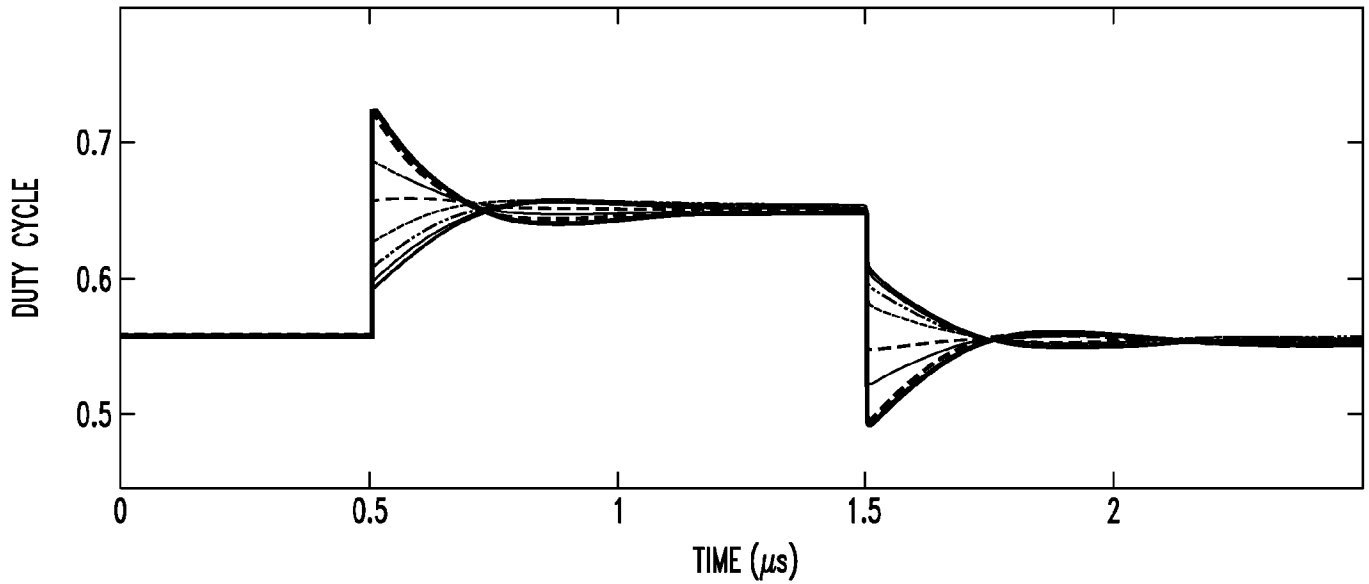

FIGS. 5A and 5B illustrate the role of the charge pumps in equalizing the duty cycles among the distributed UREGs 300. More specifically, FIGS. 5A and 5B are diagrams that illustrate a simulated response of a distributed voltage regulator system (such as depicted in FIG. 4) to an unbalanced load demand across the Vreg power grid 420. FIG. 5A is a simulated load step and FIG. 5B illustrates simulated changes in duty cycles of multiple UREGs in response to the simulated load step of FIG. 5A. In the simulation, a distributed voltage regulator system was defined to have 8 UREGs connected at different points of an RC-extracted power grid, and a load step was introduced at one end of the RC-extracted power grid.

In FIG. 5B, before time t1=0.5 μs, the duty cycle of each UREG is the same, approximately 56%. At time t1, a load step (FIG. 5A) occurs and the duty cycles of the UREGs increase in response to the load step. The UREGs connected closest to the disturbance on the power grid immediately increase their duty cycles initially to 72%, while the UREG connected furthest from the disturbance on the power grid immediately increases its duty cycle initially to 59%. However, since each UREG receives matched UP/DOWN currents from one VREGC, after some time t2=1 μs (while the load step is still occurring), feedback through the dedicated charge pumps in the multiple UREGs slowly restores equal duty cycles (to about 65%) among the multiple UREGs in a steady state (satisfying Eqn. 1).

Thereafter, as further shown in FIG. 5B, at time t3=1.5 μs, when the load step (FIG. 5A) ends, the duty cycles of the UREGs immediately decrease different amounts. In particular, the UREGs connected closest to the disturbance on the power grid immediately decrease their duty cycles lower than the UREG connected furthest from the disturbance on the power grid. However, since each UREG receives matched UP/DOWN currents from one VREGC, after some time t4=2 μs (after the load step ends), feedback through the dedicated charge pumps in the UREGs slowly restores equal duty cycles (about 56%) among the multiple UREGs in a steady state (satisfying Eqn. 1).

As shown by the simulation of FIGS. 5A and 5B, the use of a dedicated charge pump in each UREG in a distributed voltage regulator system (such as shown in FIG. 4) ensures balanced load sharing among distributed UREGS by adjusting the trip point (reference voltage VCP) of each local high-speed voltage comparator in each UREG compensating for mismatch, IR drop, etc., and providing a robust regulated grid.

FIG. 4 further illustrates control circuit block 430 having a passgate strength calibration control block 440 and a start-up comparator 450, which are used in various control protocols for controlling the dual-loop voltage regulator system. For instance, the start-up comparator 450 generates a control signal (START bit) that is applied to each UREG 300 at initialization (start-up) to fully turn on each passgate P1 and charge the output node until Vreg is high enough to provide normal operation, and to raise the charge pump voltage VCP (trip point) in each UREG 300 for faster convergence to the target regulated voltage. The start-up comparator 450 is used to detect when Vreg<Vset, where Vset is a voltage that is set to be less than the minimum target regulated voltage (so that during normal operation the comparator 450 is always off) but high enough to ensure proper regulator functionality. This start-up control scheme will be described in further detail below with reference to FIG. 8.

The passgate calibration block 440 implements one or more control schemes to dynamically calibrate the effective active device width of the PFET passgates in each UREG to minimize intrinsic ripple amplitude on Vreg. For instance, as discussed in detail below with reference to FIG. 9, a RANGE bit scheme can be employed for setting the active device width of a PFET passgate based on nominal input/output voltages. Moreover, as discussed in detail below with reference to FIG. 10, a PFET strength control loop can also be used, in which a finite state machine is implemented to adjust the active device width of a replica passgate in response to an N-bit control signal so that its drain current matches a reference current or a replica load current, thereby compensating for variations over PVT corners.

Figure 6:
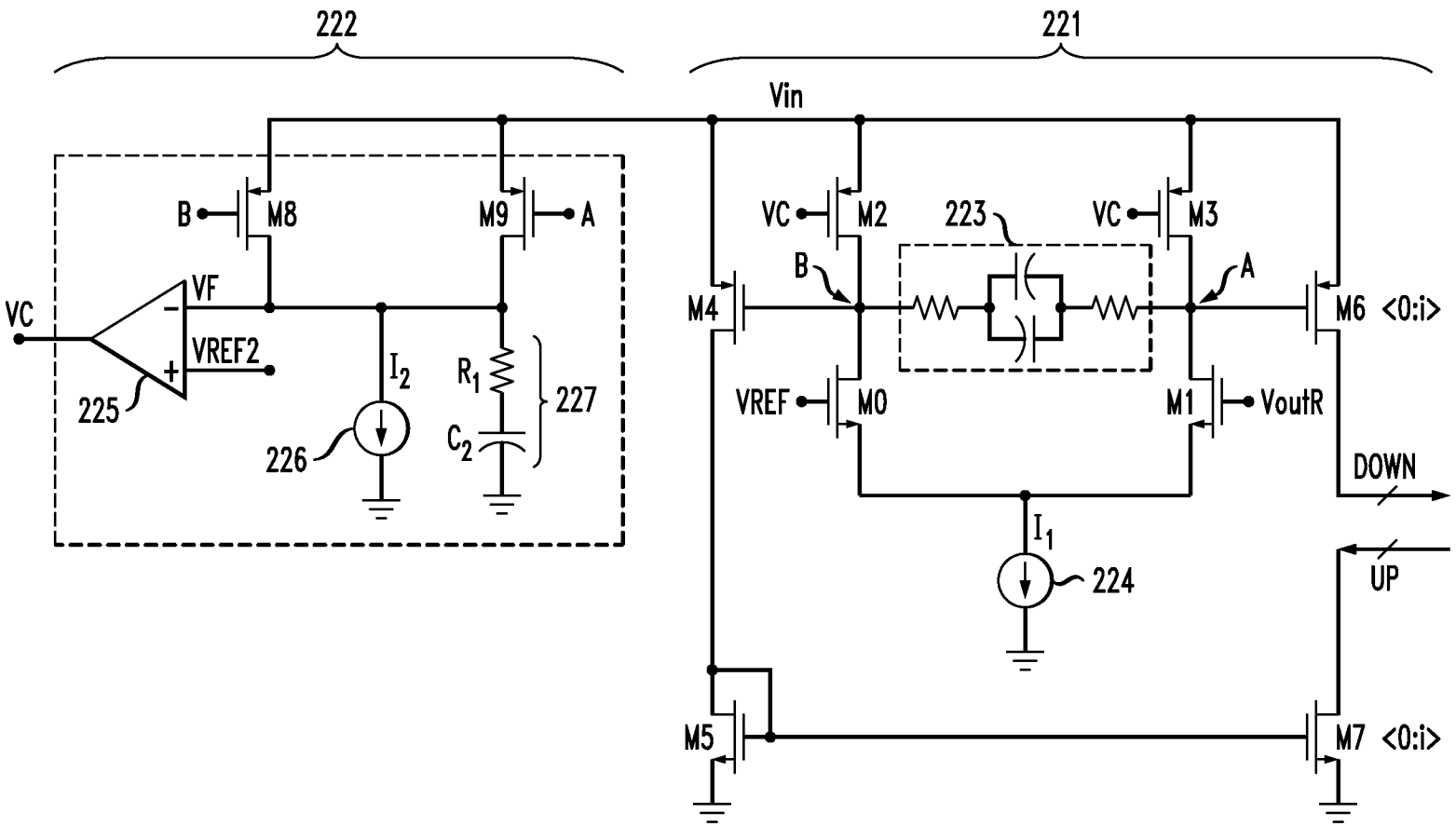
FIG. 6 schematically illustrates a transconductance amplifier according to an exemplary embodiment of the invention, which may be utilized to implement an error amplifier in the system of FIGS. 1 and 4.

FIG. 6 schematically illustrates a transconductance amplifier according to an exemplary embodiment of the invention. More specifically, FIG. 6 illustrates an exemplary embodiment of a transconductance error amplifier 220 which may be utilized to implement the error amplifier 220 in the VREGC 200 as shown in FIGS. 1 and 4. In general, the error amplifier 220 comprises a high-gain transconductance amplifier circuit 221 (or "Gm amplifier") and a common-mode feedback network circuit 222 (or "CM network"). The Gm amplifier 221 comprises a plurality of MOS transistors M0, M1, M2, M3, M4, M5, M6, M7, a lag compensation filter 223, and a tail current source 224. The CM network 222 comprises a plurality of MOS transistors M8 and M9, a feedback error amplifier 225, a tail current source 226 and an RC filter 227.

More specifically, the Gm amplifier 221 comprises a differential input stage formed by differential transistor pair M0/M1 and active load transistor pair M2/M3. The gates of transistors M0 and M1 are differential inputs which receive VREF and VoutR, respectively. The drains of transistors M1 and M3 are connected to the first output node A of the differential input stage and the drains of transistors M0 and M2 are connected to a second output node B of the differential input stage. The lag compensation filter 223 is connected between the output nodes A and B. The lag compensation filter 223 reduces the gain of the Gm amplifier 221 at high frequencies and thereby improves stability of the outer feedback loop of the voltage regulator system. The tail current source 224 biases the differential input stage with a bias current I1.

As further shown in FIG. 6, in the Gm amplifier 221, transistor M6 represents a plurality of mirror transistors <0:i> each having a gate terminal commonly connected to Node A, a source terminal commonly connected to Vin, and drain terminals separately connected to a different UREG (e.g., UREGs 300_0, . . . , **300_*i*), to supply matched DOWN control currents to the charge pump circuits in the UREGs. Similarly, transistor M7 represents a plurality of mirror transistors <0:i> each having a gate terminal commonly connected to a gate terminal of transistor M5, a source terminal commonly connected to ground, and drain terminals separately connected to a different UREG (e.g., UREGs 300_0, . . . , 300_*i*), to sink matched UP control currents from the charge pump circuits in the UREGS. The transistor M4 has a gate terminal connected to node B, a source terminal connected to Vin and a drain terminal connected to the drain and gate terminals of transistor M5**.

In the CM network 222, transistors M9 and M8 have gate terminals that are connected to output nodes A and B, respectively, and source terminals that are commonly connected to Vin. The transistors M8 and/M9 have drain terminals that are commonly connected to an inverting input terminal (VF) of the feedback error amplifier 225, the tail current source 226 and the RC compensation network 227. A second reference voltage VREF2 is applied to a non-inverting terminal of the feedback error amplifier 225. The feedback error amplifier 225 compares the input voltages VF and VREF2 and outputs a compare signal VC. The output of the feedback error amplifier 225 is connected to the gate terminals of the active load transistor pair M2/M3, wherein the transistor M2 and M3 are biased by the voltage output VC of the common-mode feedback error amplifier 225.

The error amplifier 220 of FIG. 6 generally operates as follows. The differential input stage formed by transistors M0/M1 and M2/M3, compares a difference between VoutR and reference voltage VREF (set point). If VoutR is greater than VREF, the output of the Gm amplifier 221 will generate more DOWN control current (which it sources via transistor M6) than UP control current (which it sinks via transistor M7). On the other hand, if VREF is greater than VoutR, the output of the Gm amplifier 221 will generate more UP control current (which it sinks via transistor M7) than DOWN control current (which it sources via transistor M6). Moreover, if VoutR equals VREF, the UP and DOWN control currents will be equal. In all cases, the CM network 222 provides feedback to the GM amplifier 221 so that the sum of the UP and DOWN control currents will be equal to a set value 12 (e.g., 50 uA) which is determined by the value of the current source 226 biasing transistors M8/M9.

More specifically, the CM network 222 operates as follows. The CM network 222 monitors the voltages at output nodes A and B, which are input to the gates of transistors M9 and M8, respectively. The feedback error amplifier 225 compares the input voltages VF and VREF2 and outputs a compare signal VC as feedback to the GM amplifier 221. This feedback signal VC modulates the gate potential of M2/M3 such that the sum of the drain currents flowing through M2 and M3 is maintained equal to a current value I1 (e.g., 200 uA) of the tail current sink 224 biasing differential pair M0/M1. Moreover, the feedback signal VC serves to adjust the voltage at nodes A and B so that the sum of the drain currents flowing through transistors M8/M9 and transistors M4/M6 is equal to the bias current I2 of the tail current source 226.

In particular, in the common-mode feedback loop, if the voltage potential of nodes A and B is too low, such that the sum of drain currents of M8/M9 exceeds I2 (e.g., 50 uA), the output VC of the feedback error amplifier 225 will transition lower. In turn, this will drive the gates of M2/M3 lower, increasing the drain currents of transistors M2/M3, and pulling the output nodes A and B higher. The feedback will continue to function in this manner until the sum of the drain currents of M8/M9 equals I2 (e.g., 50 uA).

Moreover, in one preferred embodiment, transistors M4/M6 are geometrically matched to transistors M8/M9. Furthermore, the gates of transistors M4/M8 are connected together at node B and the gates of M6/M9 are connected together at node A, yielding a common gate-to-source voltage potential between the connected pairs. Once the common-mode feedback loop 222 is active to maintain the sum of the drain currents flowing through transistor pair M8/M9 equal to I2 (e.g., 50 uA), the sum of the drain currents flowing through transistors M4/M6 will likewise be maintained equal to I2 (e.g., 50 uA) because of the geometrical matching between M8/M9 and M4/M6.

Finally, since M4 is connected to node B, the drain current flowing through M4 will be mirrored to transistor M7 through M5 (assuming a 1:1 mirroring gain between a mirror formed by M5/M7). In this manner, the drain current flowing in M4 will equal the drain current flowing in transistor M7. As such, the common mode voltage maintained in this way at nodes A and B ensures that the sum of the drain currents (UP and DOWN control currents) flowing through respective transistors M7 and M6 will be maintained equal to I2 (e.g., 50 uA).

In other exemplary embodiments of the invention, the transistors M4/M6 can be scaled versions of transistors M8/M9, rather than geometrically matched. In such instance, the sum of the UP and DOWN control currents flowing in transistors M7 and M6 would be maintained at some value that is a multiple of I2, and not exactly I2 as in the embodiment discussed above where M4/M6 and M8/M9 are geometrically matched.

Together, the combination of the Gm amplifier 221 and the common-mode feedback network 222 provides a high gain error amplifier with a pseudo-differential current output with an I2/2 (e.g., 25 uA) common-mode level. To ensure stability in the loop path of the common-mode feedback network 222, the RC compensation network 227 is implemented between the inverting input of the feedback error amplifier 225 and ground.

Figure 7:
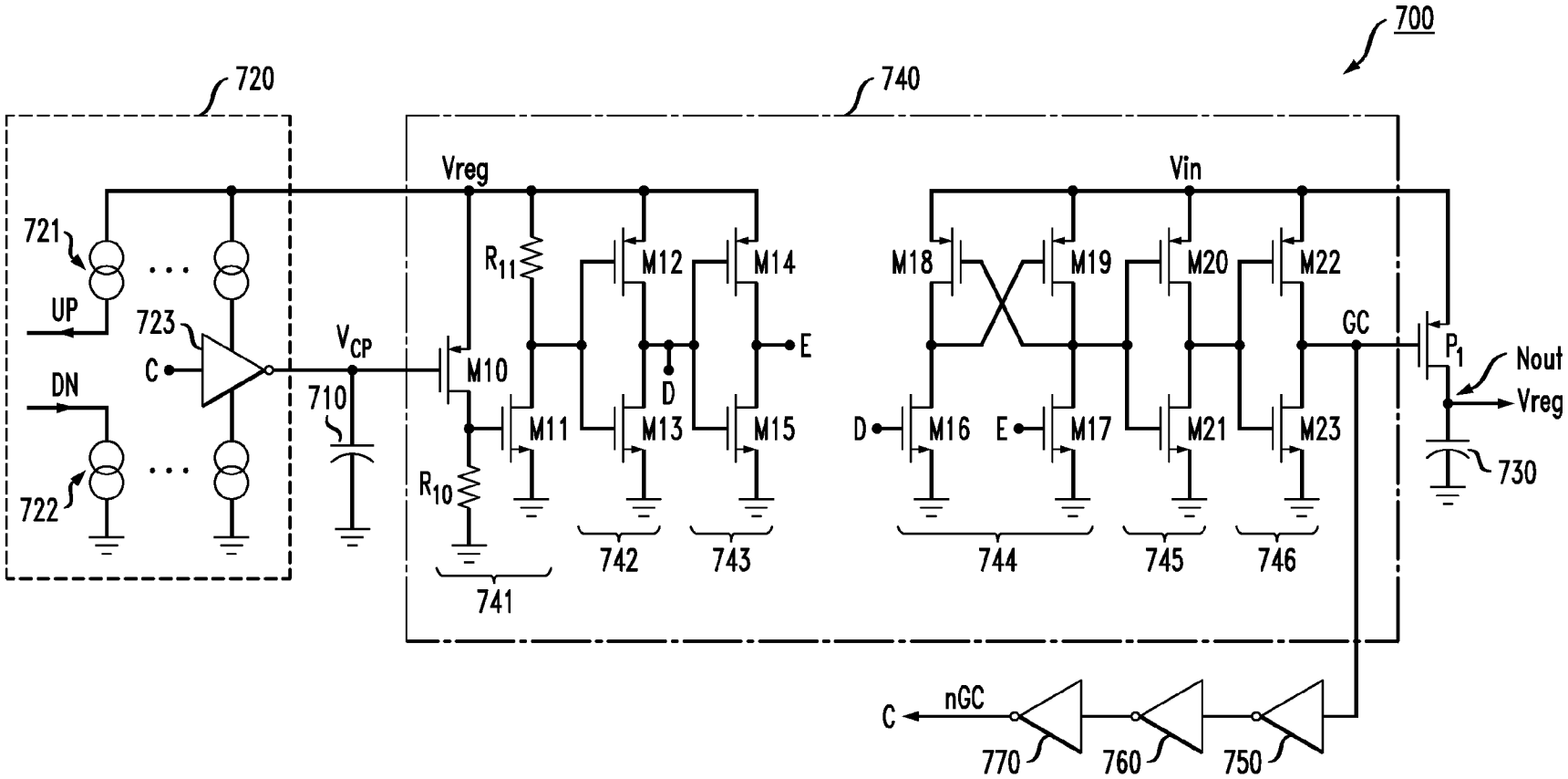
FIG. 7 schematically illustrates a micro-regulator circuit according to another exemplary embodiment of the invention.

FIG. 7 schematically illustrates a microregulator circuit according to an exemplary embodiment of the invention. In particular, FIG. 7 is a schematic circuit diagram of a UREG 700, which may be used to implement the UREG 300 of FIG. 2 according to an exemplary embodiment of the invention. The UREG 700 comprises a charge pump 720, capacitor 710, and high-speed comparator 740, passgate P1, output capacitor 730, and inverter stages 750, 760, and 770. The charge pump 720 includes current mirrors 721 and 722 and inverter 723. The charge pump 720 may have architecture as depicted in FIG. 2, where the switches S1 and S2 are implemented by a PFET and NFET respectively, with a common gate input at node C. The output of inverter 723 is connected to the capacitor 710 to charge/discharge the capacitor 710 to provide a reference voltage $V_{CP}$ to the input of the high-speed comparator 740.

The comparator 740 comprises a plurality of stages including a linear amplifier input stage 741, inverter stages 742 and 743, a level shifter stage 744, and output inverter stages 745, 746. The linear amplifier stage 741 comprises a common gate amplifier stage comprising PFET transistor M10 and resistor R10, where a gate terminal of M10 is connected to the $V_{CP}$ capacitor 710 and a source terminal is connected to the regulated voltage output node Nout (Vreg). The linear amplifier stage 741 further comprises a common source amplifier stage comprising transistor M11 and resistor R11, where the gate terminal of M11 is connected to the drain of M10. The inverter 742 comprises transistors M12 and M13, and the inverter 743 comprises transistors M14 and M15. The linear amplifier input stage 741 and inverter stages 742 and 743 are powered using the regulated output voltage Vreg at the output node Nout as the supply voltage.

The level shifter stage 744 comprises transistors M16, M17, M18, and M19. The gate of M16 is connected to the output of inverter 742 at node D and the gate of M17 is connected to the output of inverter 743 at node E. The output inverter stage 745 comprises transistors M20 and M21, and the output inverter stage 746 comprises transistors M22 and M23. The level shifter stage 744 and inverter stages 745 and 746 are powered using Vin as the supply voltage.

The common gate amplifier (formed by M10 and R10) senses a difference between Vreg and the reference voltage $V_{CP}$ (i.e., Vreg−$V_{CP}$). As the difference Vreg−$V_{CP}$ goes higher or lower than 1 overdrive voltage, the voltage across R10 (at the gate of M11) will increase or decrease, such that M11 will turn more On or more Off. The inverters 742 and 743 serve to amplify the output (drain of M11) of the linear amplifier stage 741 to rail-to-rail (Vreg to Ground) voltage levels. By using the regulated output voltage Vreg as the supply voltage of the critical sense amplifiers 741 in the error amplifier 740, better power supply rejection ratio (PSRR) is obtained. Since the sense amplifiers of the high-speed comparator 740 used to monitor Vreg are powered off Vreg itself, the possibility of introducing unwanted noise from some other supply level is eliminated altogether.

Since the analog sense amplifiers 741 are powered off the regulated voltage Vreg, the level shifter stage 744 is included in the UREG critical path to translate the rail-to-rail voltage levels to Vin and ground so that the passgate P1 can be fully turned on and off. The inverter stages 745 and 746 are included to further amplify and output control signal GC without having to load the level shifter stage 744 with the passgate P1.

The gate of the passgate P1 is connected to the feedback inverters 750, 760 and 770 to generate an inverted gate control signal nGC at node C, which is fed back to the charge pump 720 to drive the switching circuit 723. In one preferred embodiment, the inverting buffers are powered by Vreg (rather than Vin) which serves to decouple the control signal nGC from the noise of Vin. Moreover, in other exemplary embodiments of the invention, depending on the architecture of the charge pump circuit and/or other design considerations, the switching circuit 723 of the charge pump can be driven by a buffered version of the control signal GC, rather than an inverted version (nGC) of the control signal GC, as discussed above. Moreover, to eliminate charge redistribution errors in the charge pump, the charge pump circuit 720 can be implemented with the current steering techniques as discussed above with reference to FIG. 3.

Although the UREG framework in FIG. 7 provides enhanced PSRR, a start-up challenge exists in that the sense amplifiers 741 of the high-speed comparator 740 and the charge pump 720 of the microregulator 700 are not functional if Vreg is too small (e.g., near 0V). For example, in FIG. 7, at power up, there is no Vreg at the output node Nout, so the charge pump 720 is not functional and there is no way to generate Vreg. To address this issue, the control circuit 450 depicted in FIG. 4 can be implemented to generate a "START" bit control signal that is used to turn on the PFET passgate P1 until Vreg is high enough, and increase the reference voltage VCP for faster convergence to target regulated voltage. The low speed comparator 450 in the control block 430 detects when Vreg<Vset, where Vset is chosen to be less than a minimum target regulated voltage Vreg (e.g., 150 mV lower than the Vreg spec). The Vset value is selected to be high enough for the UREG and charge pump to start operating, but low enough to not interfere during normal operation (so that during normal operation this comparator 450 is always off).

Figure 8:
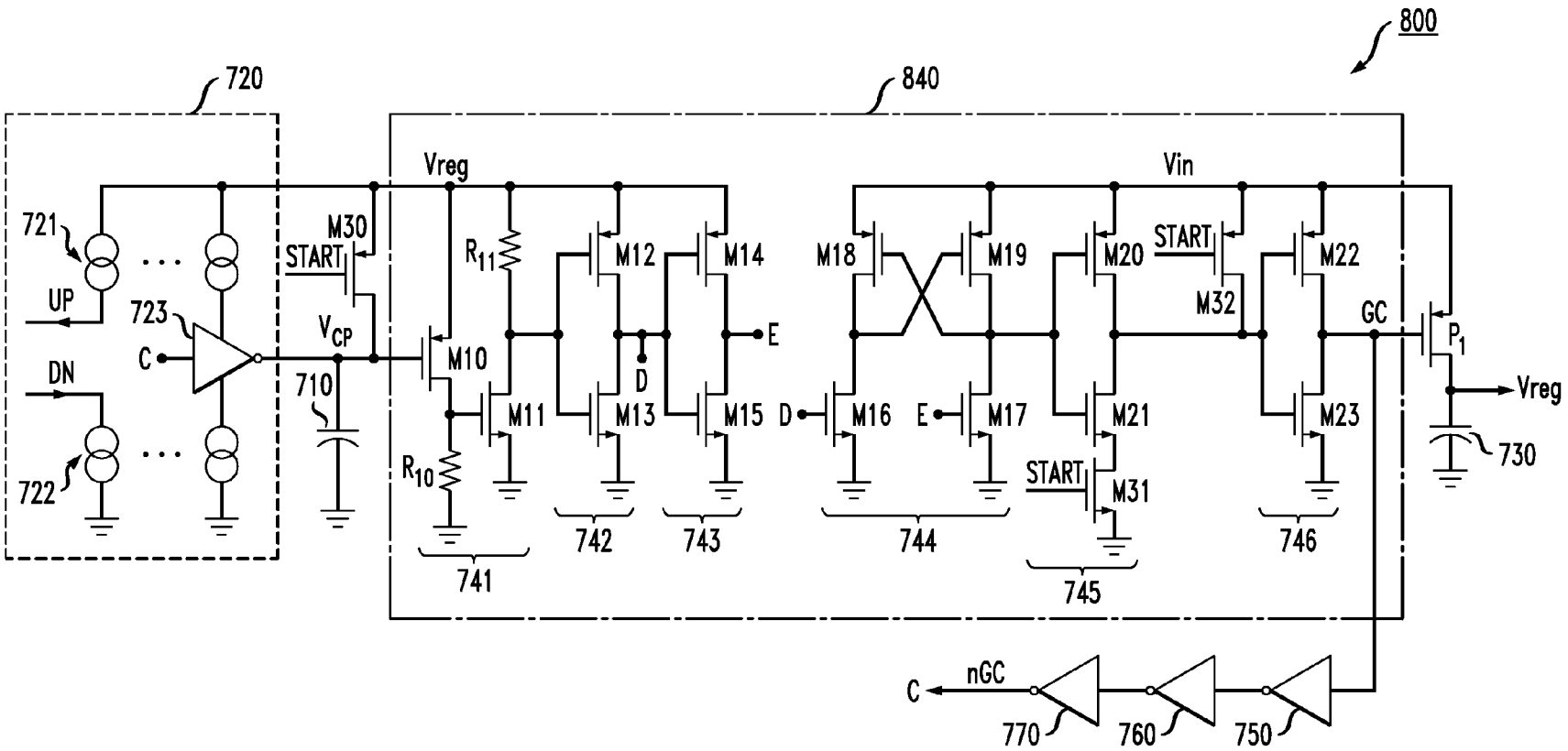
FIG. 8 schematically illustrates a micro-regulator circuit having start-up initialization control circuitry, according to another exemplary embodiment of the invention.

FIG. 8 schematically illustrates a microregulator circuit according to an exemplary embodiment of the invention, in which a START bit scheme is implemented in the UREG of FIG. 7. In particular, FIG. 8 schematically illustrates a UREG 800 which is similar to that of FIG. 7, except for additional transistors M30, M31, and M32 that are controlled by the START bit control signal. The transistor M30 is connected between Vreg supply node and the $V_{CP}$ capacitor 710. A comparator 840 in FIG. 8 is similar to the comparator 740 of FIG. 7 except for the addition of the transistors M31 and M32 in the output inverter stage 745. The use of transistors M31 and M32 adds a gating function to the inverter 745, which essentially (logically) turns the inverter 745 into a NAND gate.

More specifically, upon start-up (initialization) of the UREG 800, the low speed comparator 450 (in the control block 430 of FIG. 4) will detect that Vreg<Vset, and then generate an active "low" START bit control signal, which is input to the gate terminals of M30, M31 and M32. In this initial state, the transistor M31 will be turned "Off" and the transistor M32 will be turned "On", thereby gating off inverter stage 745 and pulling the input of the inverter stage 746 to Vin. In this state, the inverter 746 outputs a logic "low" gate control signal GC to the gate of passgate P1, which causes the passgate P1 to fully turn On and output current to charge the capacitor 730 and increase the regulated voltage level (Vreg) at the regulated output node.

Moreover, in this initial state, the active "low" START bit control signal input to the gate of transistor M30 causes the charge pump output capacitor 710 to be shunted to the regulated output node Vreg (which provides the supply voltage to the charge pump 720 and the input stages of the comparator 840). As the voltage level of Vreg increases, the voltage $V_{CP}$ across the capacitor 710 increases.

When Vreg meets the predefined threshold Vset, the comparator 450 (FIG. 4) will output a logic "high" START bit control signal, which causes transistors M30 and M32 to turn "Off", thereby decoupling the Vreg supply node from the reference voltage $V_{CP}$ node and decoupling the input to inverter stage 746 from the Vin supply voltage node. Moreover, a logic "high" START bit control signal causes transistor M31 to turn "on" and allow operation of the inverter 745 in the comparator 840.

In other exemplary embodiments of the invention, additional control circuitry may be employed to calibrate an effective active size of the PFET passgate with respect to process, voltage and temperature (PVT) variations to minimize intrinsically generated ripple amplitude. Without calibration, the active width of the PFET passgate must be sized to handle the weakest corner (e.g. minimum VDS across passgate). Moreover, as the anticipated load current increases and the VDS headroom lowers, the size of the passgate must be increased to provide sufficient current. Consequently, the PFET passgate may be too strong (in other words oversized) for other corners (e.g. max VDS). This results in increased intrinsic ripple amplitude of the regulated voltage Vreg, which is undesirable. In accordance with exemplary embodiments of the invention, enhanced performance can be achieved by calibrating the PFET size using a Range bit scheme (FIG. 9) or PFET strength control loop scheme (FIG. 10) as will be discussed in further detail below.

Figure 9:
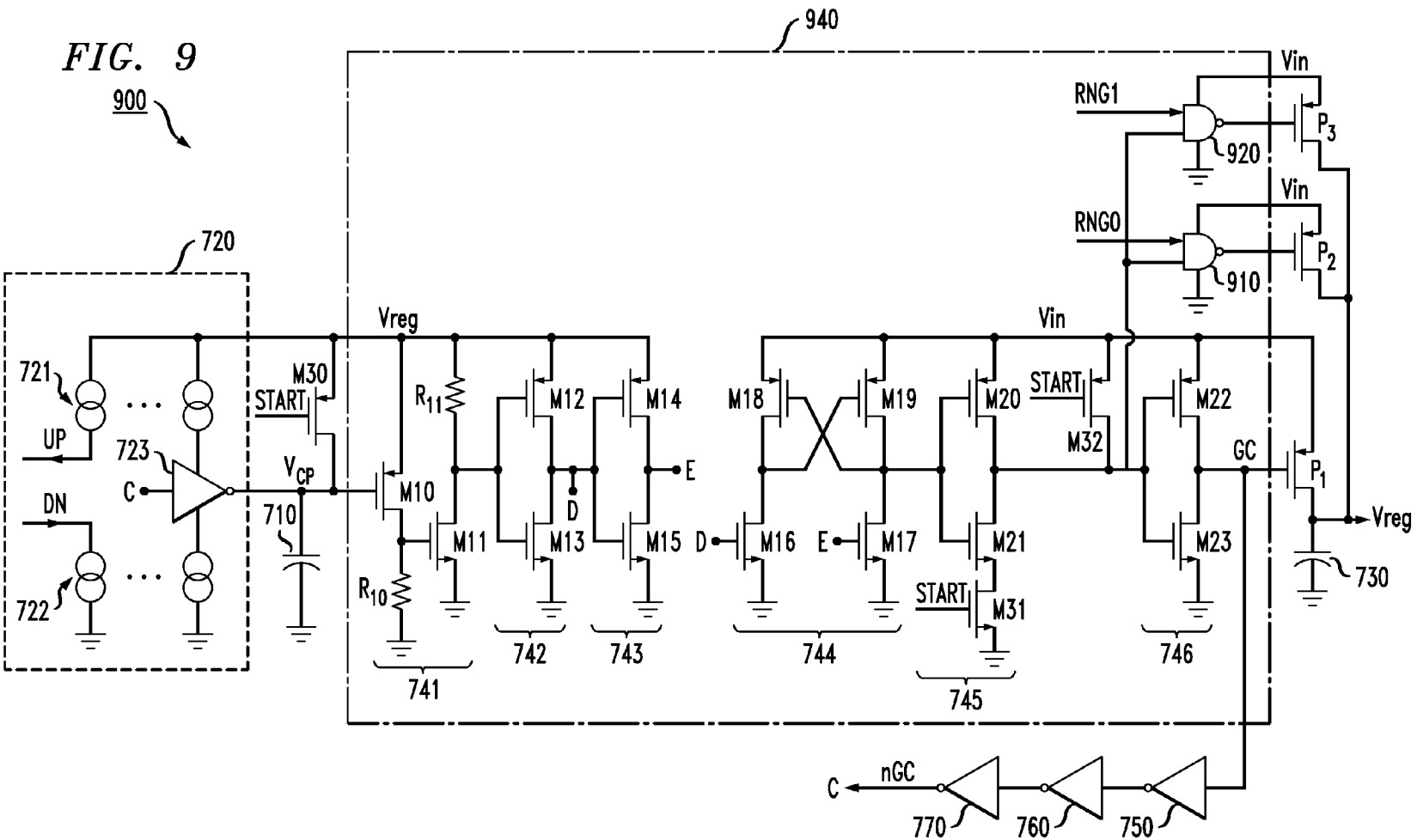
FIG. 9 schematically illustrates a micro-regulator circuit having a passgate strength calibration control system, according to an exemplary embodiment of the invention.

FIG. 9 schematically illustrates a microregulator circuit according to another exemplary embodiment of the invention, in which a Range bit control scheme is implemented to calibrate an active size of the PFET passgate. In FIG. 9, a UREG 900 is shown having a comparator 940 that is similar to that depicted in FIG. 8, except for the inclusion of additional NAND gates 910 and 920 (or gated inverters) and passgates P2 and P3. The NAND gates 910 and 920 drive respective passgates P2 and P3, which are connected in parallel to passgate P1. The NAND gates 910 and 920 are connected in parallel to inverter 746, and the NAND gates 910 and 920 and inverter 746 have a common input node.

In this scheme, during normal operation of the microregulator 900 (after start up), the inverter 746 is always enabled to drive the primary passgate P1 and supply current to the output node Nout to drive the regulated voltage Vreg. However, the primary passgate P1 can be made smaller (less width) so that the ripple amplitude on the regulated voltage Vreg due to operation of the passgate P1 alone will be lower. When the passgate strength is weaker due to lower VDS headroom (operation with smaller Vin), the active strength of the passgate needed to drive the regulated voltage Vreg can be increased by enabling one or more additional passgates P2 and P3 in parallel with the passgate P1 so as to increase the current supply capability to drive the regulated voltage Vreg.

More specifically, with this control scheme, the range bit control signals (RNG0, RNG1) can be generated by control logic based on the given supply voltage Vin used for the target application. When the range bit control signals RNG0, RNG1 are logic "low", the output of the respective NAND gates 910 and 920 will always be logic "high" irrespective of the logic level at the other input to the NAND gates 910 and 920. As such, the output of the NAND gates 910 and 920 will be held to logic "high" (e.g., Vin), and the respective passgates P2 and P3 will be turned "Off". On the other hand, when the range bit control signals RNG0, RNG1 are logic "high", the output of the NAND gates 910 and 920 will depend on the logic level of the second control input commonly connected to the input of the inverter 746, so that the passgates P2 and P3 are controlled in a bang-bang manner by the output of respective NAND gates 910 and 920.

Depending on the application, this scheme allows one or more of the additional passgates P2 and P3 to be enabled for operation based on a target supply voltage Vin over a range of possible Vins, e.g., 1.25, 1.35, 1.5 volts, etc. One or more of the passgates P2 and P3 can be enabled in circumstances where the system is intended to be operated in lower headroom voltage settings for the output device (e.g. Vin is reduced) so that the total PFET passgate strength is sufficient. In higher headroom voltage settings, a smaller segment of the PFET passgate can be enabled, thereby reducing ripple amplitude to acceptable levels.

In the exemplary embodiment of FIG. 9, the "Range" bit control scheme can be used to set the active device width of the PFET passgate based on nominal input/output voltages to compensate for variations in PFET passgate headroom, but this scheme does not account for process and temperature variations. FIG. 10 schematically illustrates a passgate strength calibration control system according to another exemplary embodiment of the invention for controlling passgate strength. In particular, FIG. 10 schematically illustrates a passgate calibration control system 10 that provides enhanced ripple performance by employing a PFET strength control loop based on a replica PFET.

Figure 10:
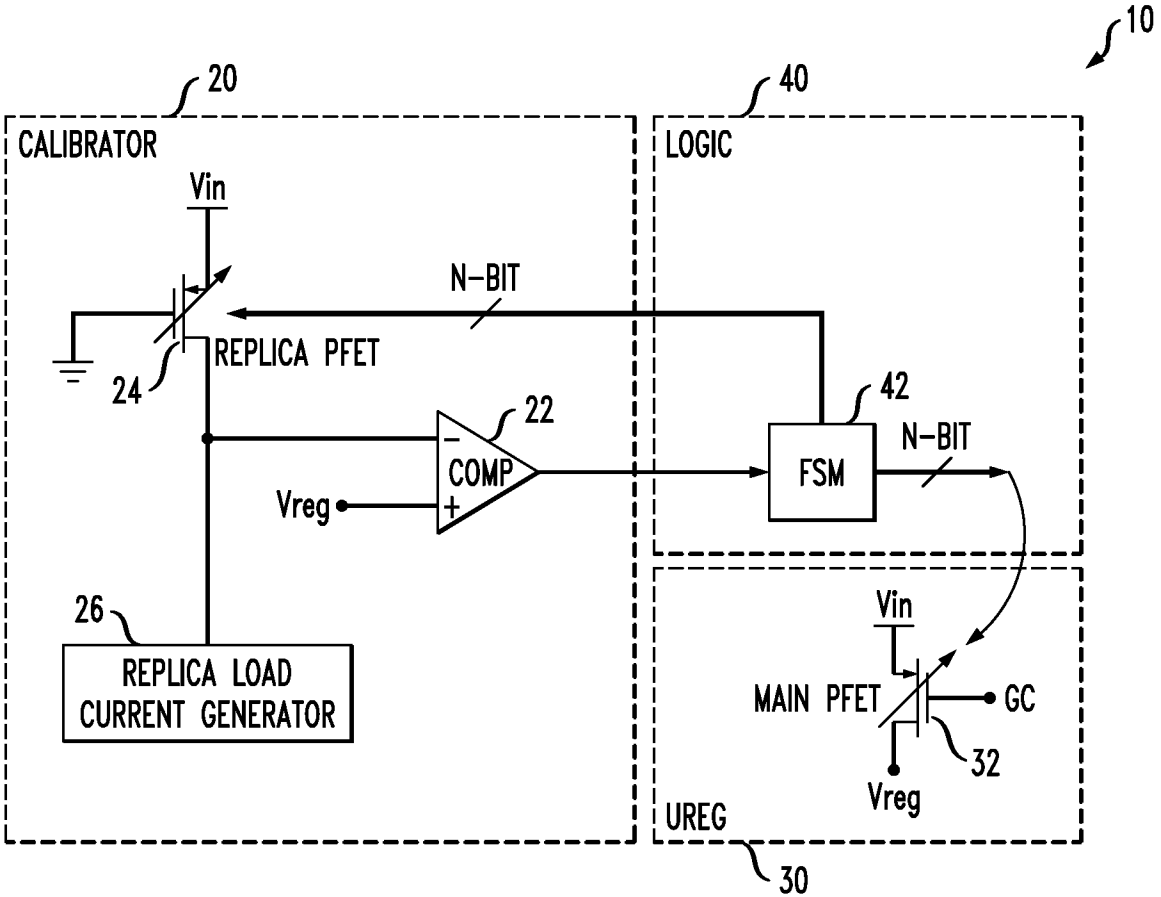
FIG. 10 schematically illustrates a passgate strength calibration control system according to another exemplary embodiment of the invention.

In FIG. 10, the control system 10 comprises a calibration block 20, a UREG block 30 and a control logic block 40. The calibration block 20 comprises a comparator 22, a replica PFET passgate circuit 24, and a replica load current generator circuit 26. The UREG block 30 includes a PFET passgate circuit 32. The logic block 40 comprises a FSM (finite state machine) block 42 that generates an N-bit control signal to selectively control the effective width (and thus strength) of the main passgate circuit 32.

In particular, the passgate circuit 32 comprises a plurality of different passgate segments, e.g., transistors PFET(0), PFET(1), PFET(2) . . . PFET(N−1), which are connected in parallel. The transistors PFET(0), PFET(1), PFET(2) . . . PFET(N−1) may be binary weighted transistors with the first transistor PFET0 having a width of $2^0$ times a reference width, the second transistor PFET1 having a width $2^1$ times the reference width, the third transistor PFET2 having a width $2^2$ times the reference width, etc. The different widths in passgates supply different supply currents to drive the regulated voltage Vreg. Thus, the device width (strength of passgate 32) can be varied as needed. For instance, with a 5-bit signal, 32 different settings for PFET strength can be realized. In other embodiments, the different segments of the passgate circuit 32 may be sized the same or differently (but not binary weighted), but where different segments of the passgate circuit 32 can be selectively activated/deactivated by the N-bit control signal to vary the active device width of the passgate circuit 32.

In the calibration block 20, the replica passgate circuit 24 and replica load current generator 26 serve as a reference circuit that is used to set or calibrate a maximum "ON" current of the main passgate circuit 32 for a given PVT to minimize ripple. Similar to the main passgate circuit 32, the replica passgate circuit 24 comprises a plurality of replica PFET transistors (RPFET(0), RPFET(1), RPFET(2) . . . RPFET(N−1) connected in parallel which may have widths (e.g., binary weighted) similar to the main passgate circuit 32, but where the widths of the replica PFETs may be a fraction (e.g., ½) of the widths of the corresponding main PFET passgates 32 PFET(0), PFET(1), PFET(2) . . . PFET(N−1) (to reduce power consumption in the replica circuitry).

The replica load current generator 26 serves as a reference circuit that is representative of a portion of the actual system load which is preferably operated with a maximum activity factor. This reference circuit is used to determine the "on" current for the main passgate circuit 32 for a given PVT. In particular, the comparator 22 has a non-inverting terminal connected to the regulated supply node and an inverting terminal connected to the drain of replica passgate 24. The comparator 22 compares the voltage at the drain node of the replica passgate 24 with Vreg and outputs a compare signal to the FSM 42. The FSM 42 generates an N-bit control signal to turn on/off different segments of the replica passgate 24 to make the voltage at the drain node of the replica passgate 24 to be as equal as possible to Vreg. The VDS value of the replica passgate 24 will be equal to the VDS value of the main passgate 32 because the source nodes are connected to Vin, and the drain voltage of the replica passgate is made equal to Vreg. The replica passgate 24 is always on because its gate terminal is grounded. When the voltage at the drain node of the replica passgate circuit 24 is determined to be Vreg, the FSM 42 determines that the optimum is reached for a given load current, so the N-bit setting is applied to the main passgate circuit 32 to turn On/Off the appropriate segments.

Thus, in the calibration control scheme of FIG. 10, a N-bit control signal output from the FSM 42 is used to find the optimum number of active PFET fingers needed to supply worst case load current (maximum activity rate). The replica load current may be generated by a downsized replica load circuit mimicking the actual behavior of load over PVT. In other embodiments, the replica load current generator 26 may be replaced with a fixed current source, in which case the "On" current of the main passgate circuit 32 can be calibrated to a fixed current level. In other words, with the fixed current source, the active width of the main passgate circuit 32 is calibrated to the fixed current level so that the full "on" current of the passgate circuit 32 is equal to a fixed current for different headrooms and temperatures. Accordingly, with correct scaling factors, the main passgate circuit 32 within the UREG 30 will have an optimum strength to maintain proper voltage regulation under worst case load conditions with minimum generated ripple amplitude on regulated voltage. It is to be appreciated that the exemplary embodiments of FIGS. 9 and 10 can be combined where main passgate in FIG. 9 is controlled by circuitry of FIG. 10.

An integrated circuit in accordance with the present invention can be employed in any application and/or electronic system. Suitable systems for implementing the invention may include, but are not limited to, personal computers, communication networks, electronic commerce systems, portable communications devices (e.g., cell phones), solid-state media storage devices, etc. Systems incorporating such integrated circuits are considered part of this invention. Given the teachings of the invention provided herein, one of ordinary skill in the art will be able to contemplate other implementations and applications of the techniques of the invention.

Although illustrative embodiments of the invention have been described herein with reference to the accompanying drawings, it is to be understood that the invention is not limited to those precise embodiments, and that various other changes and modifications may be made therein by one skilled in the art without departing from the scope of the appended claims.

What is claimed is:

1. A voltage regulator circuit, comprising:

an error amplifier to compare a first reference voltage and a regulated voltage at an output node of the voltage regulator circuit, and to generate a first control current and a second control current based on a result of comparing the first reference voltage and the regulated voltage;

a charge pump circuit, connected to an output of the error amplifier, to dynamically generate a second reference voltage in response to the first and second control currents generated by the error amplifier;

a comparator to compare the second reference voltage and the regulated voltage and generate a gate control signal based on a result of comparing the second reference voltage and the regulated voltage; and a first passgate device connected to the output node, wherein the first passgate device is controlled by the gate control signal to be fully turned on/off in a bang-bang mode of operation to supply current to the output node.

2. The voltage regulator circuit of claim 1, wherein the charge pump circuit dynamically generates the second reference voltage by switchably applying the first and second control currents to a charge pump capacitor, connected at an output of the charge pump circuit, to charge and discharge the charge pump capacitor.

3. The voltage regulator circuit of claim 2, wherein the charge pump circuit comprises a switching circuit that is controlled by an inverted version of the gate control signal to switchably apply the first and second control currents to the charge pump capacitor.

4. The voltage regulator circuit of claim 2, wherein the charge pump circuit comprises a switching circuit that is controlled by a buffered version of the gate control signal to switchably apply the first and second control currents to the charge pump capacitor.

5. The voltage regulator circuit of claim 1, wherein the comparator comprises an input stage that is powered by the regulated voltage at the output node of the voltage regulator circuit.

6. The voltage regulator circuit of claim 1, wherein the charge pump circuit is powered by the regulated voltage at the output node of the voltage regulator circuit.

7. The voltage regulator circuit of claim 1, further comprising a first control circuit to generate a first control signal upon startup of the voltage regulator circuit to (i) turn on the first passgate device upon startup of the voltage regulator circuit to increase a voltage level of the regulated voltage at the output of the voltage regulator circuit to a predefined voltage level and to (ii) increase a voltage level of the second reference voltage.

8. The voltage regulator circuit of claim 1, further comprising:

a second passgate device, connected in parallel with the first passgate device; and a second control system to calibrate a total passgate strength for supplying current to the output node, by selectively activating the second passgate device to operate in parallel with the first passgate device.

9. The voltage regulator circuit of claim 8, wherein the second control system generates a control signal that selectively activates a driver to drive the second passgate device, based on one of a plurality of supply voltage settings.

10. The voltage regulator of claim 8, wherein the second control system comprises:

a replica reference circuit to determine a maximum load current under real-time operating conditions; and control logic to generate an activation control signal that selectively activates one of or both of the first and second passgate devices to provide minimum passgate strength sufficient to supply the determined maximum load current.

11. The voltage regulator of claim 10, wherein the first and second passgate devices are binary-weighted with respect to a common reference passgate device width, and wherein the activation control signal is an N-bit signal.

12. An integrated circuit chip comprising the voltage regulator of claim 1.

13. An integrated circuit, comprising:

a power grid;

a load circuit connected to the power grid; and a distributed voltage regulator system comprising a voltage regulator control circuit and one or more micro-regulator control circuits, wherein each of the one or more micro-regulator control circuits has a respective output node connected to a different point on the power grid, and wherein each of the one or more micro-regulator control circuits are controlled by the voltage regulator control circuit to generate a respective regulated voltage at the respective output node of the micro-regulator control circuit to collectively supply a regulated voltage on the power grid to the load circuit, wherein the voltage regulator control circuit comprises an error amplifier to compare a first reference voltage to a regulated voltage at a sense point of the power grid, and to generate a first control current and a second control current based on a result of comparing the first reference voltage and the regulated voltage at the sense point of the power grid; and wherein each of the one or more micro-regulator control circuits comprises:

a charge pump circuit, connected to an output of the error amplifier, to dynamically generate a respective second reference voltage in response to the first and second control currents generated by the error amplifier;

a comparator to compare the respective second reference voltage and the respective regulated voltage at the respective output node of the micro-regulator control circuit, and generate a gate control signal based on a result of comparing the respective second reference voltage and the respective regulated voltage; and a first passgate device connected to the respective output node, wherein the first passgate device is controlled in a bang-bang mode of operation by the gate control signal to supply current to the respective output node.

14. The integrated circuit of claim 13, wherein the charge pump circuit of each micro-regulator control circuit dynamically generates the respective second reference voltage by switchably applying the first and second control currents to a charge pump capacitor, connected at an output of the charge pump circuit, to charge and discharge the charge bump capacitor.

15. The integrated circuit of claim 14, wherein the charge pump circuit of each micro-regulator control circuit comprises a switching circuit that is controlled by an inverted version of the gate control signal to switchably apply the first and second control currents to the charge pump capacitor.

16. The integrated circuit of claim 14, wherein the charge pump circuit of each micro-regulator control circuit comprises a switching circuit that is controlled by a buffered version of the gate control signal to switchably apply the first and second control currents to the charge pump capacitor.

17. The integrated circuit of claim 13, wherein the comparator of each micro-regulator control circuit comprises an input stage that is powered by the respective regulated voltage at the respective output node of the micro-regulator control circuit.

18. The integrated circuit of claim 13, wherein the charge pump circuit of each micro-regulator control circuit is powered by the respective regulated voltage at the respective output node of the micro-regulator control circuit.

19. The integrated circuit of claim 13, further comprising a first control circuit to generate a first control signal upon startup of the distributed voltage regulator system to (i) turn on the first passgate device of each micro-regulator control circuit upon startup of the voltage regulator circuit to increase a voltage level of the respective regulated voltage at the respective output node of the micro-regulator control circuit to a predefined voltage level and to (ii) increase a voltage level of the respective second reference voltage.

20. The integrated circuit of claim 13, wherein each of the one or more micro-regulator control circuits further comprises a second passgate device, connected in parallel with the first passgate device; and wherein the integrated circuit further comprises a second control system to calibrate a total passgate strength for each of the one or more micro-regulator control circuits to supply current to the respective output nodes, by selectively activating the second passgate device of the one or more micro-regulator control circuits to operate in parallel with the first passgate device.

21. The integrated circuit of claim 20, wherein the second control system generates a control signal that selectively activates a driver to drive the second passgate device, based on one of a plurality of supply voltage settings.

22. The integrated circuit of claim 20, wherein the second control system comprises:

a replica reference circuit to determine a maximum load current under current real-time operating conditions; and control logic to generate an activation control signal that selectively activates one of or both of the first and second passgate devices to provide minimum passgate strength sufficient to supply the determined maximum load current.

23. The integrated circuit of claim 22, wherein the first and second passgate devices in each of the one or more micro-regulator control circuits are binary-weighted with respect to a common reference passgate device width.

24. A method for regulating voltage, comprising:

comparing a reference voltage with a regulated voltage;

generating a first control current and a second control current based on a result of comparing the reference voltage with the regulated voltage;

dynamically generating a second reference voltage based on the first and second control currents wherein dynamically generating a second reference voltage comprises outputting the first and second control currents to a charge pump circuit, and switchably applying the first and second control currents to a charge pump capacitor, connected at an output of the charge pump circuit, to charge and discharge the charge pump capacitor;

comparing the second reference voltage with the regulated voltage;

generating a gate control signal based on a result of comparing the second reference voltage with the regulated voltage; and controlling a first passgate device in a bang-bang mode of operation using the gate control signal to supply current to a regulated voltage output node.

25. The method of claim 24, wherein switchably applying the first and second control currents to the charge pump capacitor comprises controlling a switching circuit of the charge pump circuit using an inverted version of the gate control signal to switchably apply the first and second control currents to the charge pump capacitor.

* * * * *